US008008585B2

(12) United States Patent
Mills et al.

(10) Patent No.: US 8,008,585 B2
(45) Date of Patent: Aug. 30, 2011

(54) SWITCHING APPARATUS COMPRISING A PLURALITY OF SWITCHING ASSEMBLIES, AND ASSOCIATED METHOD

(75) Inventors: Patrick Wellington Mills, Bradenton, FL (US); Peter Lee Nerstrom, Sarasota, FL (US); James Michael McCormick, Bradenton, FL (US)

(73) Assignee: Eaton Corporation, Cleveland, OH (US)

( * ) Notice: Subject to any disclaimer, the term of this patent is extended or adjusted under 35 U.S.C. 154(b) by 407 days.

(21) Appl. No.: 12/325,600

(22) Filed: Dec. 1, 2008

(65) Prior Publication Data

US 2010/0133076 A1 Jun. 3, 2010

(51) Int. Cl.
*H01H 9/26* (2006.01)
*H01H 9/16* (2006.01)

(52) U.S. Cl. ..... 200/50.32; 200/308; 200/310

(58) Field of Classification Search ..... 200/5 B, 200/5 C, 50.32, 50.33, 50.36, 50.37, 50.4; 337/43, 66, 70, 101; 335/18
See application file for complete search history.

(56) References Cited

U.S. PATENT DOCUMENTS

| | | | | |
|---|---|---|---|---|
| 3,142,732 | A * | 7/1964 | Clarke et al. | 200/50.32 |
| 3,307,002 | A | 2/1967 | Cooper | |
| 3,486,150 | A | 12/1969 | Clarke | |
| 4,110,719 | A * | 8/1978 | Kirkup | 337/46 |
| 4,514,601 | A * | 4/1985 | Buchanan | 200/5 E |
| 4,980,525 | A * | 12/1990 | Kakisako | 200/50.4 |
| 6,137,069 | A * | 10/2000 | Casagrande et al. | 200/50.32 |
| 6,490,150 | B1 * | 12/2002 | Theisen et al. | 361/673 |
| 2002/0158726 | A1 * | 10/2002 | Wellner et al. | 335/18 |
| 2006/0125582 | A1 * | 6/2006 | Mills et al. | 335/172 |
| 2006/0254893 | A1 * | 11/2006 | Mills et al. | 200/313 |

FOREIGN PATENT DOCUMENTS

FR 2 108 806 A1 5/1972

* cited by examiner

*Primary Examiner* — Michael A Friedhofer
(74) *Attorney, Agent, or Firm* — Bradley J. Diedrich; Kirk Houser

(57) ABSTRACT

An improved electrical switching apparatus comprises a plurality of electrical switching assemblies in a ganged configuration. A bridging device mechanically connects together the actuator devices of the electrical switching assemblies to cause the simultaneous tripping of all of the electrical switching assemblies when an overload or an arc fault is detected on any electrical switching assembly of the gang.

16 Claims, 7 Drawing Sheets

SWITCHING APPARATUS COMPRISING A PLURALITY OF SWITCHING ASSEMBLIES, AND ASSOCIATED METHOD

BACKGROUND OF THE INVENTION

1. Field of the Invention

This invention relates to electrical switching apparatus and, more particularly, to circuit interrupters, such as, for example, aircraft or aerospace circuit breakers providing arc fault protection. The invention also relates to an electrical switching apparatus that comprises a plurality of circuit interrupters that are configured for simultaneous operation.

2. Background Information

Circuit breakers are used to protect electrical circuitry from damage due to an overcurrent condition, such as an overload condition or a relatively high level short circuit or fault condition. In small circuit breakers, commonly referred to as miniature circuit breakers, used for residential and light commercial applications, such protection is typically provided by a thermal-magnetic trip device. This trip device includes a bimetal, which heats and bends in response to a persistent overcurrent condition. The bimetal, in turn, unlatches a spring powered operating mechanism, which opens the separable contacts of the circuit breaker to interrupt current flow in the protected power system.

Subminiature circuit breakers are used, for example, in aircraft or aerospace electrical systems where they not only provide overcurrent protection but also serve as switches for turning equipment on and off. Such circuit breakers must be small to accommodate the high-density layout of circuit breaker panels, which make circuit breakers for numerous circuits accessible to a user. Aircraft electrical systems, for example, usually consist of hundreds of circuit breakers, each of which is used for a circuit protection function as well as a circuit disconnection function through a push-pull handle. Difficulty exists in developing and employing the wide variety of circuit breaker solutions that may be required for any given aircraft.

Typically, subminiature circuit breakers have provided protection against persistent overcurrents implemented by a latch triggered by a bimetal responsive to $I^2R$ heating resulting from the overcurrent. There is a growing interest in providing additional protection, and most importantly arc fault protection.

During sporadic arc fault conditions, the overload capability of the circuit breaker will not function since the root-mean-squared (RMS) value of the fault current is too small to actuate the automatic trip circuit. The addition of electronic arc fault sensing to a circuit breaker can add one of the elements required for sputtering arc fault protection—ideally, the output of an electronic arc fault sensing circuit directly trips and, thus, opens the circuit breaker. See, for example, U.S. Pat. Nos. 6,710,688; 6,542,056; 6,522,509; 6,522,228; 5,691,869; and 5,224,006.

Common methods of actuating a test function on, for example, a circuit breaker, include employing a mechanical pushbutton switch. See, for example, U.S. Pat. Nos. 5,982,593; 5,459,630; 5,293,522; 5,260,676; and 4,081,852. However, such mechanical mechanisms often fail due to mechanical stress and may be actuated by mistake. Furthermore, such mechanical mechanisms, when employed on a relatively small circuit breaker, such as, for example, a sub-miniature circuit breaker, are of relatively large size.

Proximity sensors include, for example, Hall effect sensors. These sensors, used in automatic metal detectors, change their electrical characteristics when exposed to a magnet. Usually, such sensors have three wires for supply voltage, signal and ground.

There is room for improvement in electrical switching apparatus employed in certain applications.

SUMMARY OF THE INVENTION

These needs and others are met by the present invention, which provides an electrical switching apparatus that comprises a plurality of electrical switching assemblies in the form of miniature circuit breakers that are in a ganged-together configuration. Other needs are met by an improved method of using the electrical switching apparatus.

An aspect of the invention is to configure an electrical switching apparatus out of a plurality of electrical switching assemblies, and the electrical switching assemblies can have different nominal load capacities.

Another aspect of the invention is to provide an electrical switching apparatus having a plurality of electrical switching assemblies that are bridged together for simultaneous operation.

Another aspect of the invention, therefore, is to provide an electrical switching apparatus, the general nature of which can be stated as comprising a plurality of electrical switching assemblies, a connection assembly, and a bridging device. The electrical switching assemblies each comprise a housing, separable contacts, an operating mechanism structured to open and close the separable contacts, an elongated actuator device translatable along its direction of elongation between OFF and ON positions and cooperating with the operating mechanism to open and close the separable contact, and a trip assembly cooperating with the operating mechanism to trip open the separable contacts. The connection assembly is structured to mechanically connect together the electrical switching assemblies. The bridging device is structured to mechanically connect together the actuator devices.

An inventive method of interrupting at least a portion of a circuit with the electrical switching apparatus can be generally stated as comprising triggering with the trip assembly of one of the electrical switching assemblies its operating mechanism to trip open its separable contacts and to translate its actuator device toward its OFF position, and employing the bridging device to move the actuator devices of the other electrical switching assemblies toward their OFF positions and to open their separable contacts.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The present invention is described in association with an aircraft or aerospace arc fault circuit breaker, although the invention is applicable to a wide range of electrical switching apparatus, such as, for example, circuit interrupters adapted to detect a wide range of faults, such as, for example, arc faults or ground faults in power circuits.

Figure 1:
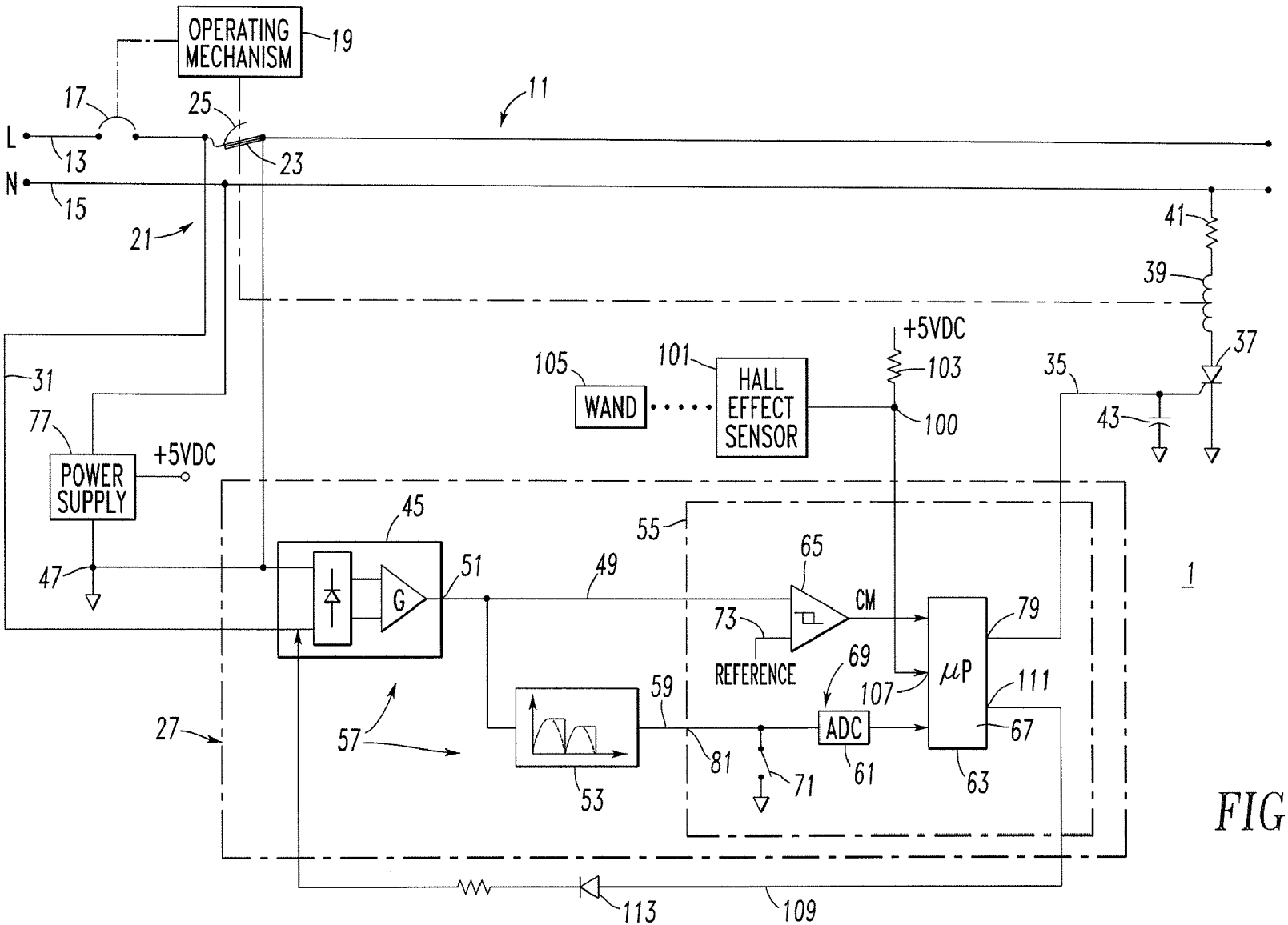
FIG. 1 is a block diagram of a circuit breaker in accordance with the present invention.

Referring to FIG. 1, an electrical switching assembly in the form of an arc fault circuit breaker 1 is connected in an electric power system 11 which has a line conductor (L) 13 and a neutral conductor (N) 15. The circuit breaker 1 includes separable contacts 17 which are electrically connected in the line conductor 13. The separable contacts 17 are opened and closed by an operating mechanism 19. In addition to being operated manually by a handle (not shown), the operating mechanism 19 can also be actuated to open the separable contacts 17 by a trip assembly 21. This trip assembly 21 includes the conventional bimetal 23 which is heated by persistent overcurrents and bends to actuate the operating mechanism 19 to open the separable contacts 17. An armature 25 in the trip assembly 21 is attracted by the large magnetic force generated by very high overcurrents to also actuate the operating mechanism 19 and provide an instantaneous trip function.

The circuit breaker 1 is also provided with an arc fault detector (AFD) 27. The AFD 27 senses the current in the electrical system 11 by monitoring the voltage across the bimetal 23 through the lead 31 with respect to local ground reference 47. If the AFD 27 detects an arc fault in the electric power system 11, then a trip signal 35 is generated which turns on a switch such as the silicon controlled rectifier (SCR) 37 to energize a trip solenoid 39. The trip solenoid 39 when energized actuates the operating mechanism 19 to open the separable contacts 17. A resistor 41 in series with the coil of the solenoid 39 limits the coil current and a capacitor 43 protects the gate of the SCR 37 from voltage spikes and false tripping due to noise. Alternatively, the resistor 41 need not be employed.

The AFD 27 cooperates with the operating mechanism 19 to trip open the separable contacts 17 in response to an arc fault condition. The AFD 27 includes an active rectifier and gain stage 45, which rectifies and suitably amplifies the voltage across the bimetal 23 through the lead 31 and the local ground reference 47. The active rectifier and gain stage 45 outputs a rectified signal 49 on output 51 representative of the current in the bimetal 23. The rectified signal 49 is input by a peak detector circuit 53 and a microcontroller (μC) 55.

The active rectifier and gain stage 45 and the peak detector circuit 53 form a first circuit 57 adapted to determine a peak amplitude 59 of a rectified alternating current pulse based upon the current flowing in the electric power system 11. The peak amplitude 59 is stored by the peak detector circuit 53.

The μC 55 includes an analog-to-digital converter (ADC) 61, a microprocessor (μP) 63 and a comparator 65. The μP 63 includes one or more arc fault algorithms 67. The ADC 61 converts the analog peak amplitude 59 of the rectified alternating current pulse to a corresponding digital value for input by the μP 63. The μP 63, arc fault algorithm(s) 67 and ADC 61 form a second circuit 69 adapted to determine whether the peak amplitude of the current pulse is greater than a predetermined magnitude. In turn, the algorithm(s) 67 responsively employ the peak amplitude to determine whether an arc fault condition exists in the electric power system 11.

The μP 63 includes an output 71 adapted to reset the peak detector circuit 59. The second circuit 69 also includes the comparator 65 to determine a change of state (or a negative (i.e., negative-going) zero crossing) of the alternating current pulse of the current flowing in the electric power system 11 based upon the rectified signal 49 transitioning from above or below (or from above to below) a suitable reference 73 (e.g., a suitable positive value of slightly greater than zero). Responsive to this negative zero crossing, as determined by the comparator 65, the μP 63 causes the ADC 61 to convert the peak amplitude 59 to a corresponding digital value.

The example arc fault detection method employed by the AFD 27 is "event-driven" in that it is inactive (e.g., dormant) until a current pulse occurs as detected by the comparator 65. When such a current pulse occurs, the algorithm(s) 67 record the peak amplitude 59 of the current pulse as determined by the peak detector circuit 53 and the ADC 61, along with the time since the last current pulse occurred as measured by a timer (not shown) associated with the μP 63. The arc fault detection method then uses the algorithm(s) 67 to process the current amplitude and time information to determine whether a hazardous arc fault condition exists. Although an example AFD method and circuit are shown, the invention is applicable to a wide range of AFD methods and circuits. See, for example, U.S. Pat. Nos. 6,710,688; 6,542,056; 6,522,509; 6,522,228; 5,691,869; and 5,224,006.

An output 100 of a suitable proximity sensor, such as, for example and without limitation, a Hall effect sensor 101, is held "high" by a pull-up resistor 103. When the Hall effect sensor 101 is actuated, for example, by a suitable target, such as for example and without limitation, a magnetic wand 105, the sensor output 100 is driven low (e.g., by an open drain output). When the μP 63 determines that the input 107 is low, it outputs a suitable pulse train signal 109 on output 111. That signal 109 is fed back into the input of the active rectifier and gain stage 45. In turn, the pulse train signal 109 causes the AFD algorithms 67 to determine that there is an arc fault trip condition, albeit a test condition, such that the trip signal 35 is set. A blocking diode 113 is employed to prevent any current from flowing into the μP output 111.

Figure 2:
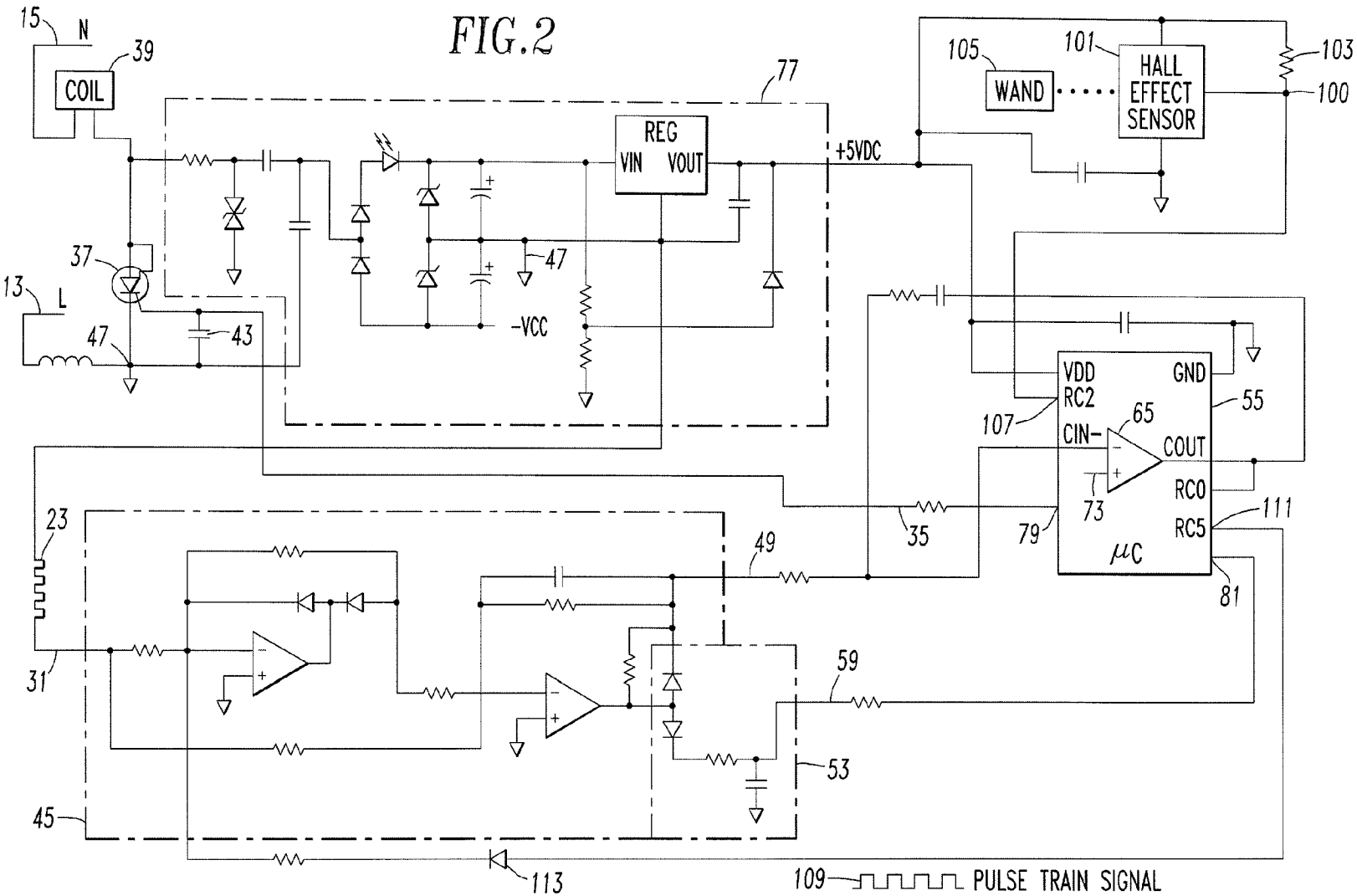
FIG. 2 is a block diagram in schematic form of a processor, power supply, active rectifier and gain stage, peak detector and Hall effect sensor of FIG. 1.

FIG. 2 is a block diagram in schematic form of the μC 55, power supply 77, active rectifier and gain stage 45, peak detector 53 and Hall effect sensor 101 of FIG. 1. The μC 55 may be, for example, a suitable processor, such as model PIC16F676 marketed by Microchip Technology Inc. of Chandler, Ariz. A digital output 79 includes the trip signal 35. An analog input 81 receives the peak amplitude 59 for the ADC 61 (FIG. 1). Digital input RC0 of μC 55 is employed to read the output (COUT) of the comparator 65. Another digital input RC2 107 of μC 55 is employed to read the sensor output 100. Another digital output RC5 111 of μC 55 includes the pulse train signal 109 to simulate an arc fault trip condition responsive to the sensing the wand 105 with the sensor 101. The μC 55, thus, forms an arc fault trip mechanism including a test circuit adapted to simulate an arc fault trip condition to trip open the separable contacts 17 (FIG. 1).

Figure 3:
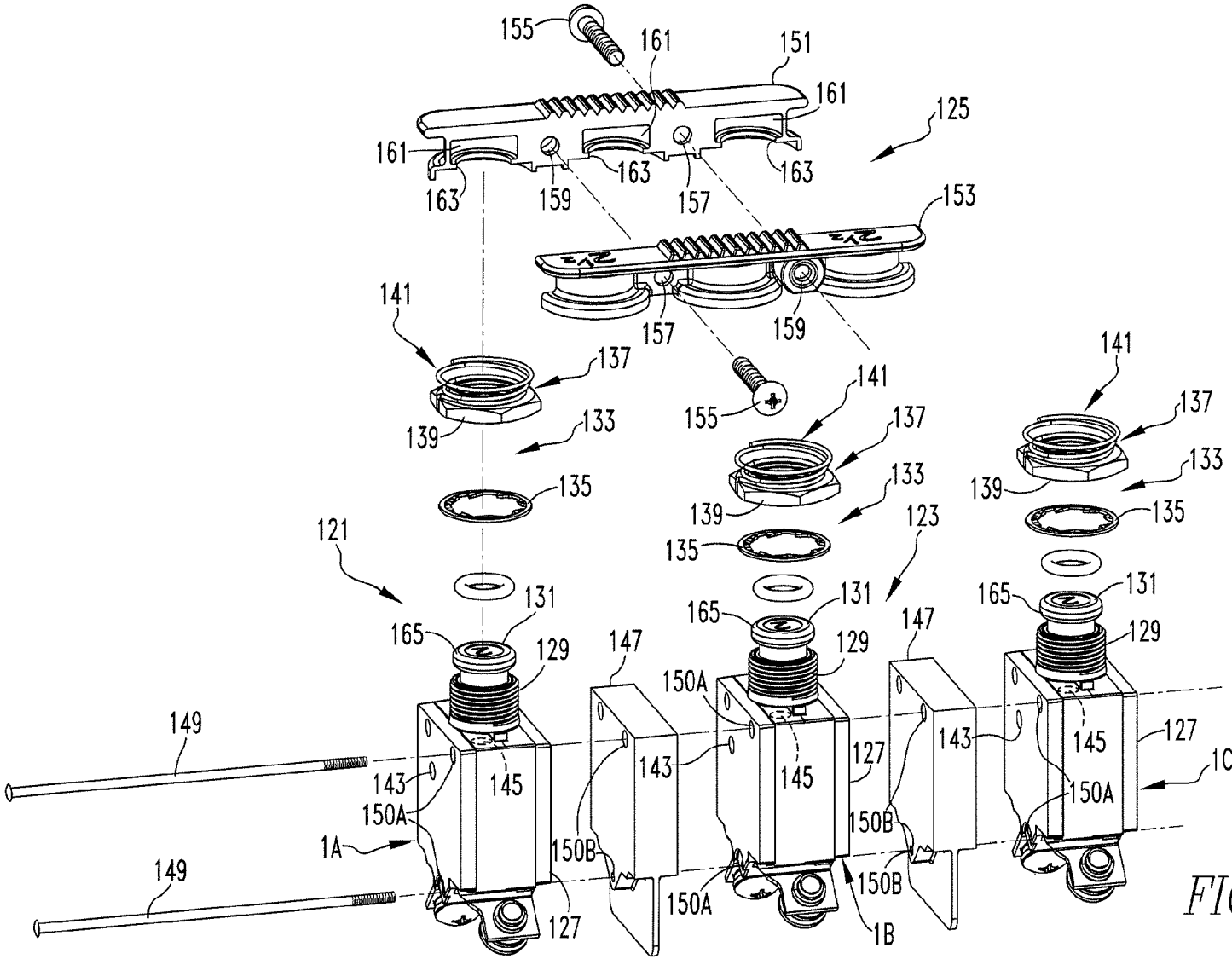
FIG. 3 is an exploded view of an electrical switching apparatus that employs the circuit breaker of FIG. 1.

FIG. 3 is an exploded view of an improved electrical switching apparatus in the form of an aircraft or aerospace circuit breaker apparatus 121 that comprises a plurality of the circuit breakers 1 that are indicated at the numerals 1A, 1B, and 1C in FIG. 3. It is noted that the circuit breakers 1A, 1B, and 1C may be different than the circuit breaker 1 without departing from the present concept.

In addition to the circuit breakers 1A, 1B, and 1C, the circuit breaker apparatus 121 comprises a connection assembly 123 and a bridging device 125. The connection assembly 123 can be said to mechanically connect together or gang the circuit breakers 1A, 1B, and 1C. The bridging device 125 can be said to operationally connect together or gang the circuit breakers 1A, 1B, and 1C, it being further noted that the bridging device 125 also mechanically connects together at least a portion of each of the circuit breakers 1A, 1B, and 1C.

As is depicted in FIG. 3, the circuit breakers 1A, 1B, and 1C can each be said to include a housing 127 upon which is disposed a threaded connector 129, an elongated actuator device 131 that is translatable along its direction of elongation between an ON position and an OFF or TRIPPED position, and a securement assembly 133 that is cooperable with the threaded connector 129 for mounting the circuit breaker apparatus 121 to a panel 166 (FIGS. 4-6) or other support.

As can be further seen in FIG. 3, the securement assembly 133 includes a lock washer 135 and a fastener assembly 137. The fastener assembly 137 comprises a fastener 139 in the exemplary form of a nut and a biasing device in the exemplary form of a conical spring 141 coupled together.

The circuit breakers 1A, 1B, and 1C further each include an illumination element 143 situated on the housing 127 which, when illuminated, indicates that certain aspects of the circuit breaker 1A, 1B, and 1C are operational. The circuit breakers 1A, 1B, and 1C further each include a proximity sensor 145 which is structured to sense a magnetic target (not expressly depicted herein). The proximity sensor 145 in the exemplary embodiment depicted herein is the Hall effect sensor 101 of FIGS. 1 and 2.

As can further be seen in FIG. 3, the connection assembly 123 includes a pair of spacers 147 and a pair of pins 149. The spacers 147 are formed of a material that is at least partially translucent and that is structured to transmit the visible light generated by the illumination elements 143. The pins 149 are received through holes 150A formed in the housings 127 and through holes 150B formed in the spacers 147 to connect together the circuit breakers 1A, 1B, and 1C and the spacers 147 in a ganged configuration. The pins 149 can be secured in the holes 150A and 150B in any of a variety of fashions, such as by flaring the free end of the pins 149 opposite the heads thereof, or in other fashions.

The bridging device 125 can be seen in FIG. 3 as comprising a first member 151 and a second member 153 that are connected together with fasteners 155 that are in the exemplary form of a machine screws. In the exemplary embodiment depicted herein, each fastener 155 is received through a thru-bore 157 formed in the first member 151 or the second members 153 and is threadably received in threaded insert 159 that is disposed on the other of the first member 1151 and the second member 153.

It can be seen that the bridging device 125 is formed with a number of receptacles 161 formed in the first and second members 151 and 153 that each include, in the exemplary embodiment depicted herein, a bracing wall 163. When assembled, the flared ends 165 of the actuator device 131 are received in the receptacles 161, with the flared end 165 engaging the bracing wall 163 to securely and mechanically connect together the actuator devices 131 with the bridging device 125.

Figure 4:
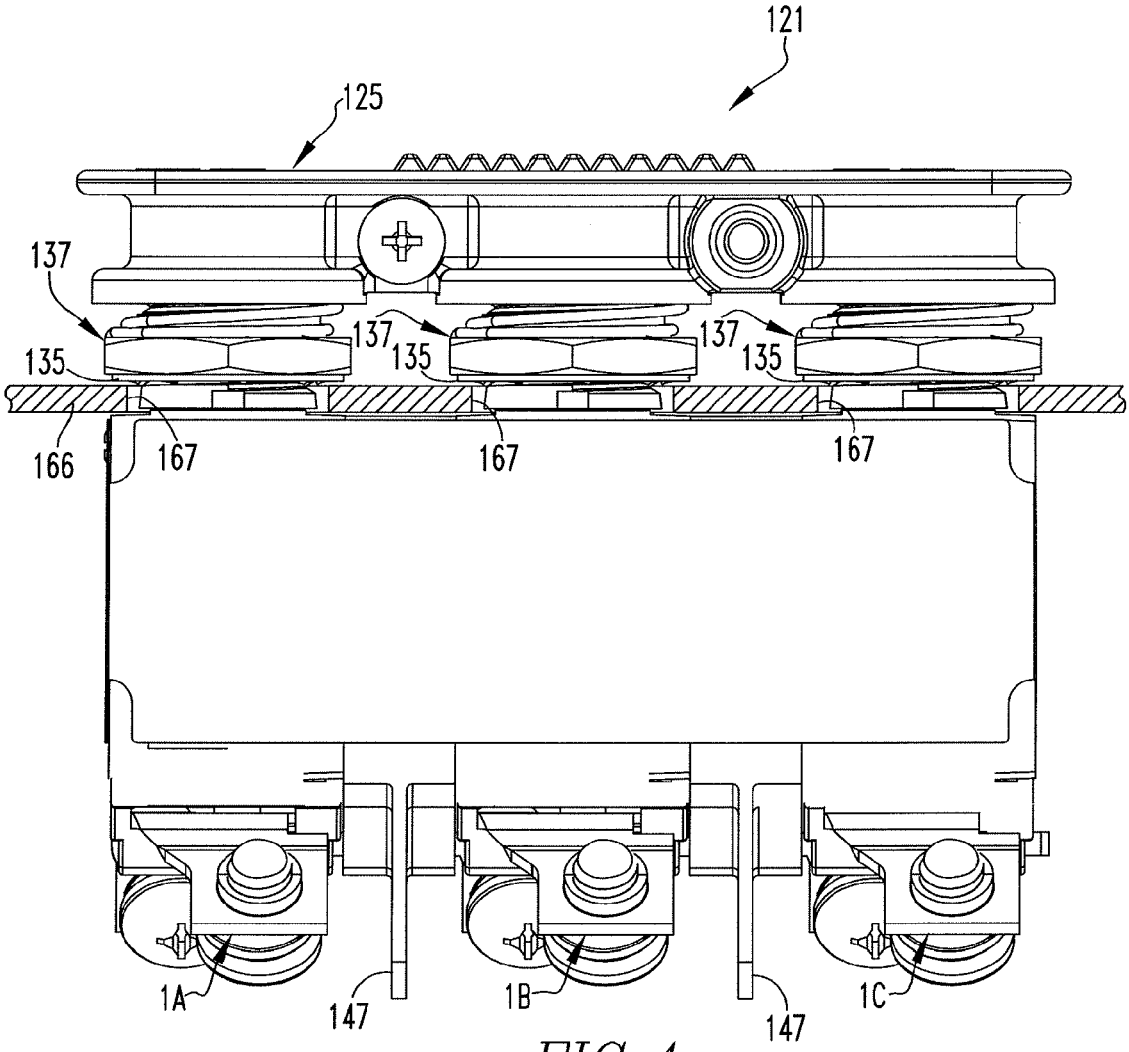
FIG. 4 is front elevational view of the electrical switching apparatus of FIG. 3 mounted to a panel and in an ON position.
Figure 5:
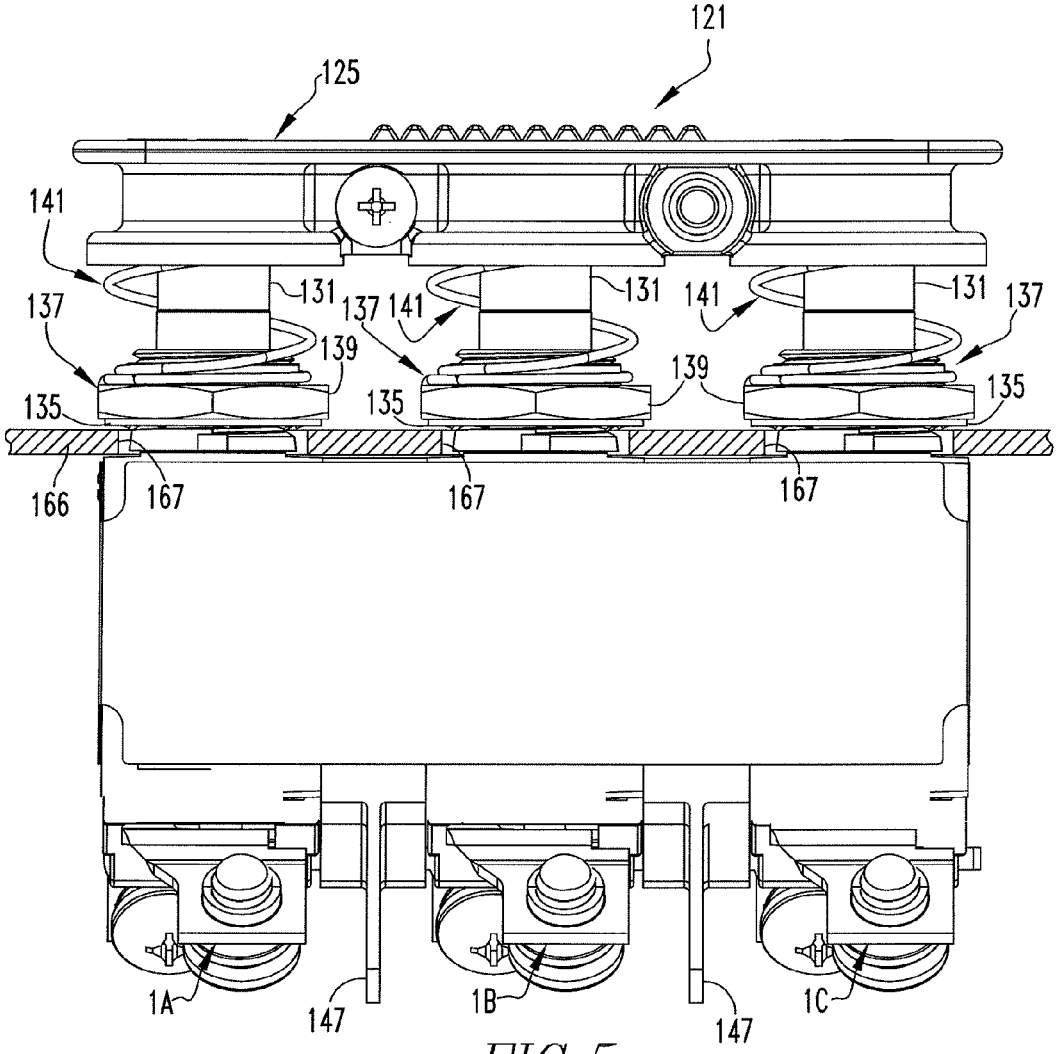
FIG. 5 is a view similar to FIG. 4, except depicting the electrical switching apparatus in an OFF or TRIPPED position.
Figure 6:
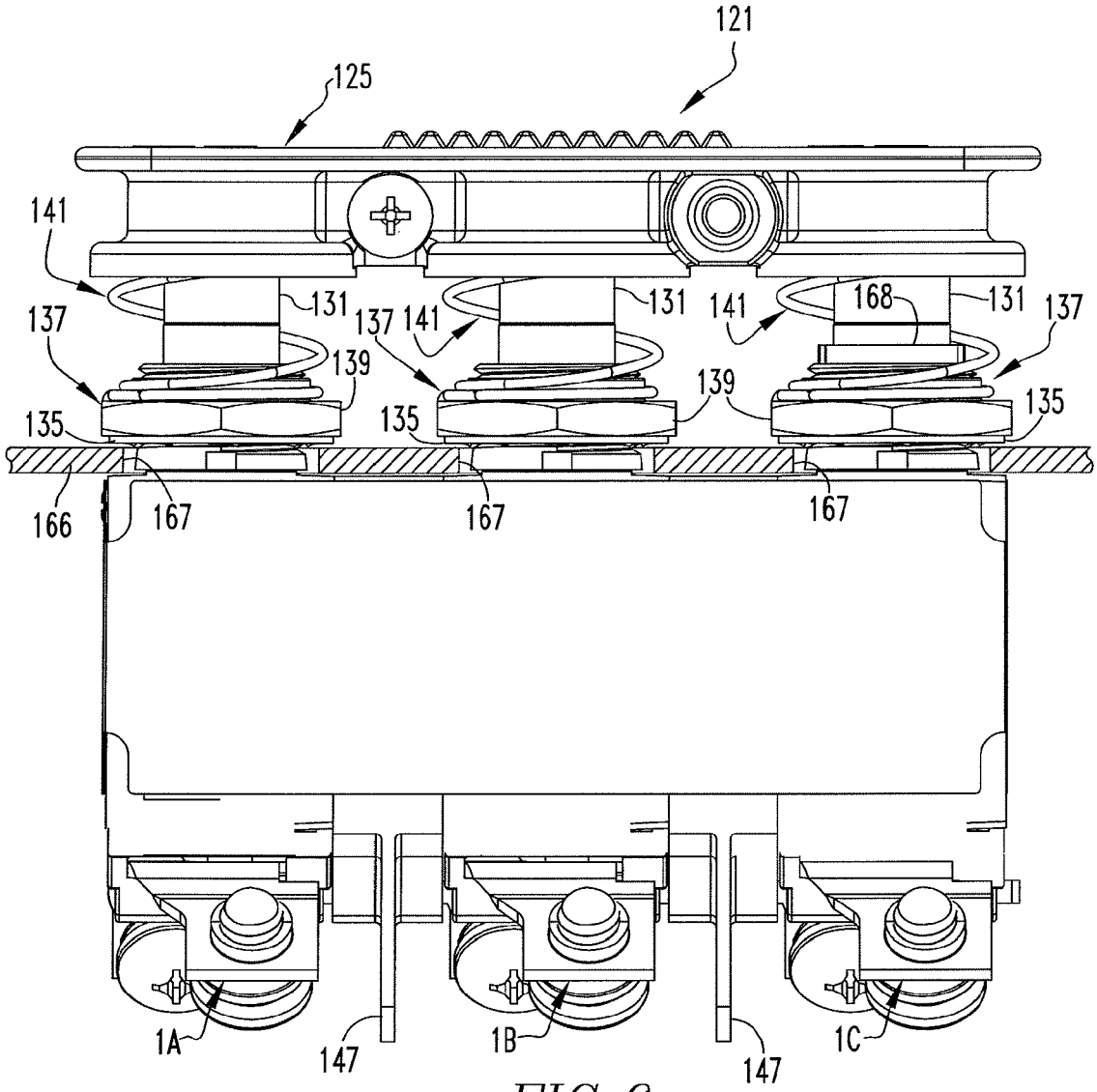
FIG. 6 is a view similar to FIG. 5, except depicting one of the circuit breakers displaying an indicator that is indicative of an arc fault condition.

The circuit breaker apparatus 121 is depicted in FIGS. 4, 5, and 6 as being in an assembled condition mounted to a panel 166, such as that of an aircraft or other device. The threaded connectors 129 are received through openings 167 formed in the panel 166. The lock washers 135 and fastener assemblies 137 are received on the threaded connectors 129, with the lock washer 135 being interposed between the fastener assembly 137 and a face of the panel 166. The bridging device 125 is then connected to the actuator devices 131 by receiving the flared ends 165 thereof in the receptacles 161 and receiving the fasteners 155 through the thru-bores 157 and the threaded inserts 159. Optionally, a resilient member may be further received in the receptacles 161 if needed to tightly brace the flared ends 165 against the bracing walls 163.

As mentioned above, the circuit breaker apparatus 121 is depicted in FIG. 4 as being in an ON position, meaning that the circuit breakers 1A, 1B, and 1C each complete an open portion of a circuit connected therewith. The bridging device 125 rigidly mechanically connects together the actuator devices 131 whereby the bridging device 125 can be used to switch the circuit breaker apparatus 121, and more specifically the circuit breakers 1A, 1B, and 1C, between the ON position of FIG. 4 and an OFF or TRIPPED position, such as is depicted generally in FIGS. 5 and 6. That is, the bridging device 125 can be used to manually switch the circuit breaker apparatus 121 between the ON and OFF positions, and can also be used to return the circuit breaker apparatus 121 to the ON position from the TRIPPED position once an overcurrent condition has ceased and/or once an arc fault condition has been resolved.

As can be understood from FIGS. 4-6, the conical spring 141 in the exemplary depicted embodiment is at all times engaged with the bridging device 125 and biases the bridging device 125 toward the OFF or TRIPPED position of the circuit breaker apparatus 121. The conical springs 141 thus assist in simultaneously moving the actuator devices 131, and thus the circuit breakers 1A, 1B, and 1C, to the OFF position in the event that one of the circuit breakers 1A, 1B, and 1C has experienced a condition that has caused it to trip.

It is understood, however, that the conical springs 141 need not be biasingly engaged with the bridging device 125 in all positions of the circuit breaker apparatus 121. For instance, the conical springs 141 may be biasingly engaged with the bridging device 125 in the ON position but may be configured to not be engaged with the bridging device 125 in the OFF or TRIPPED position.

FIG. 5 depicts the circuit breaker apparatus 121 in an OFF or TRIPPED position. Such a position can result from the bridging device 125 being manually moved in an outward direction away from the housings 127 to open the separable contacts 17 of the circuit breakers 1A, 1B, and 1C. Similarly, FIG. 5 can be representative of a TRIPPED position such as might have resulted from a thermal overload of one or more of the circuit breakers 1A, 1B, or 1C.

FIG. 6 is similar to FIG. 5, except depicting the circuit breaker apparatus 121 at the TRIPPED position with the circuit breaker 1C indicating the existence of an arc fault on that circuit. Specifically, each circuit breaker 1A, 1B, 1C further includes an indicator 168, which is indicated in FIG. 6 in conjunction with the circuit breaker 1C, and which typically remains hidden from view but is deployed by the trip assembly 21 in response to a detection by the arc fault detector 127 of an arc fault on the circuit connected with circuit breaker 1C. Advantageously, therefore, when one of the circuit breakers, such as the circuit breaker 1C, detects an arc fault, the trip assembly 21 trips open its separable contacts 17, moves the actuator device 131 to its TRIPPED i.e., OFF position, and deploys the indicator 168 as indicated in FIG. 6 in connection with the circuit breaker 1C. The movement of the actuator device 131, being connected with the bridging device 125, causes the circuit breakers 1A and 1B to be moved from their ON position to their OFF position. In so doing, the biasing of the bridging device 125 by the conical springs 141 toward the OFF positions of the circuit breakers 1A, 1B, and 1C further facilitates the simultaneous movement of all of the circuit breakers 1A, 1B, and 1C to their OFF or TRIPPED positions.

Figure 7:
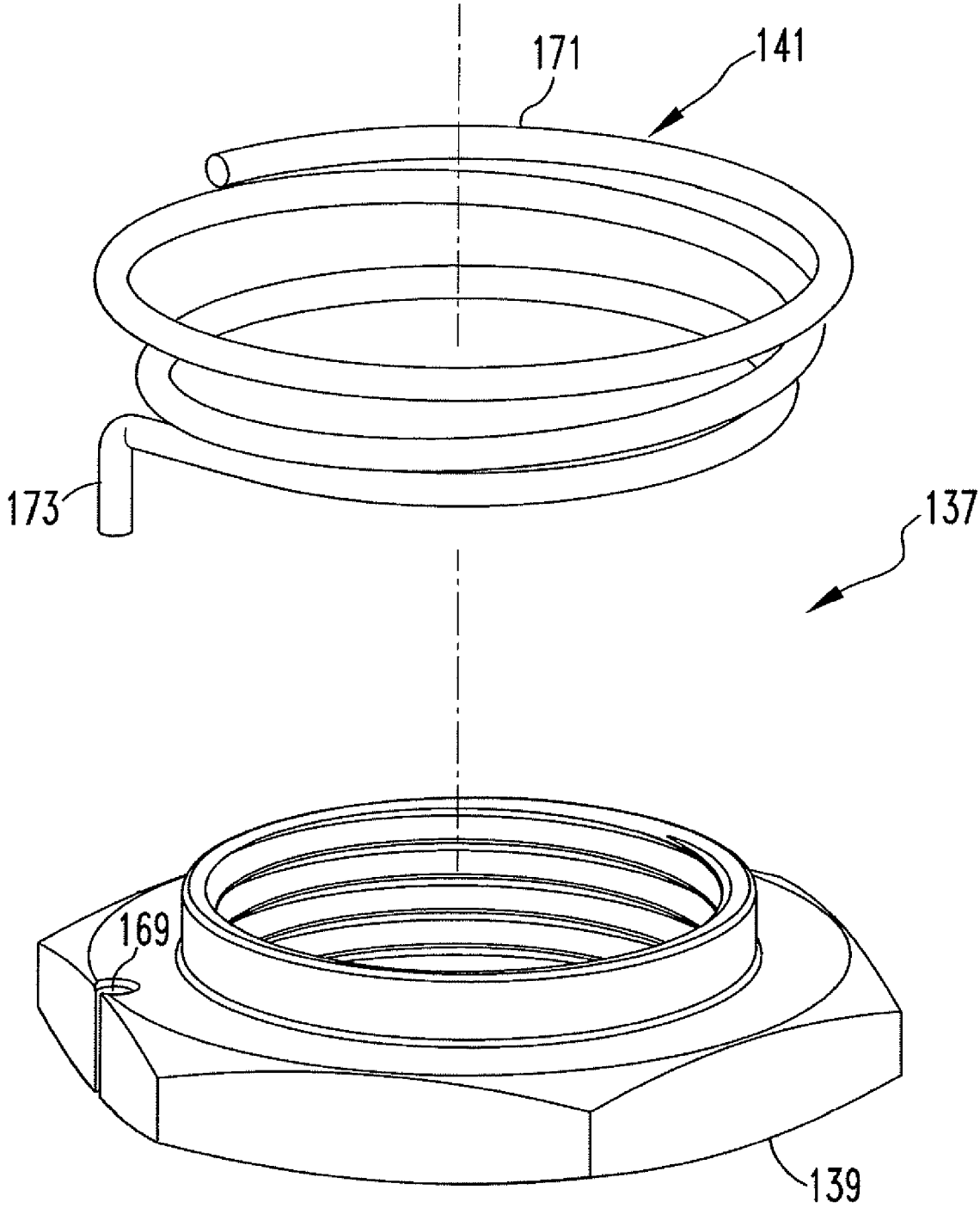
FIG. 7 is an exploded view of a fastener assembly of the electrical switching apparatus of FIG. 3.

FIG. 7 depicts in an exploded fashion the fastener assembly 137. It can be seen from FIG. 7 that the fastener 139 has a cylindrical seat 169 formed therein, and it can further be seen that the conical spring 141 includes a coil portion 171 and a tang 173. The tang 173 is received in the seat 169, likely with an interference fit, or otherwise, but in any event the conical spring 141 and the fastener 139 are coupled together for ease of installation. It is understood, however, that the conical springs 141 could be coupled to other devices, such as the bridging device 125, without departing from the present concept.

It is expressly noted that the configuration of the circuit breaker apparatus 121 can be varied from that expressly depicted herein. For instance, other embodiments of the electrical switching apparatus 121 can comprise a greater or lesser number of the circuit breakers 1 in the same ganged format. Such a configuration can be enabled by providing longer or shorter pins 149, a greater or lesser quantity of spacers 147, and a larger or smaller bridging device 125 having a quantity of receptacles 161 sufficient to receive therein the actuator devices 131 of the circuit breakers 1.

Additionally, the various circuit breakers 1 of the circuit breaker apparatus 121 or other embodiments of the circuit breaker apparatus 121 need not be of the same load carrying capacity. As is understood, the circuit breakers 1 may have a predetermined load at which the trip assembly 21 will cause the separable contacts 17 to be tripped open. It is expressly noted that, for instance, the predetermined load of one circuit breaker 1 of the circuit breaker apparatus 121 may have a nominal predetermined tripping load different than that of another circuit breaker 1 of the same circuit breaker apparatus without limitation. Such a configuration advantageously enables combinations of devices to be switched or tripped OFF in greater varieties of situations.

For instance, an embodiment might have four circuit breakers 1, with three of the circuit breakers 1 together forming a three-phase circuit interrupter, with each of the three circuit breaker 1 having a nominal load capacity of 12 amps. The fourth circuit breaker 1 of the same circuit breaker apparatus might be connected with a system that is completely separate but that has some physical or logical proximity to the system operated by the three-phase portion of the circuit breaker assembly. In such a fashion, multiple systems can be simultaneously controlled, either manually or through tripping, which increases the versatility of the circuit breaker apparatus. By way of a further example, it is noted that all of the circuits of a wire bundle might be operated by a single circuit breaker apparatus 121, i.e., by having a separate circuit breaker 1 for each such circuit in the wire bundle. Other uses of the improved circuit breaker apparatus 121 will be apparent.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An electrical switching apparatus comprising:

a plurality of electrical switching assemblies each comprising:

a housing, separable contacts, an operating mechanism structured to open and close the separable contacts, an elongated actuator device translatable along its direction of elongation between OFF and ON positions and cooperating with the operating mechanism to open and close the separable contact, an indicator that is deployable from a first position hidden from view to a deployed second position, and a trip assembly cooperating with the operating mechanism to trip open the separable contacts and to deploy the indicator;

a connection assembly structured to mechanically connect together the electrical switching assemblies; and a bridging device structured to mechanically connect together the actuator devices.

2. The electrical switching apparatus of claim 1 wherein each electrical switching assembly further comprises a biasing element structured to bias the actuator device toward the OFF position.

3. The electrical switching apparatus of claim 2 wherein in the ON position of the actuator device the biasing element engages the bridging device and biases it toward the OFF position of the actuator device.

4. The electrical switching apparatus of claim 1 wherein each trip assembly comprises:

a test circuit structured to simulate a trip condition to trip open the separable contacts; and a proximity sensor structured to sense a target to actuate the text circuit.

5. The electrical switching apparatus of claim 4 wherein the proximity sensor includes an output which is structured to be actuated when the target is sensed, and wherein the test circuit includes a processor having an input structured to receive the output of the proximity sensor and also having an output.

6. The electrical switching apparatus of claim 5 wherein the output of the processor is structured to be actuated responsive to the input of the processor receiving the actuated output of the proximity sensor.

7. The electrical switching apparatus of claim 6 wherein the trip assembly comprises an arc fault trip mechanism, and wherein the output of the processor includes a pulse train signal that is structured to simulate an arc fault trip condition for the arc fault trip mechanism.

8. The electrical switching apparatus, of claim 1 wherein the electrical switching assemblies are miniature circuit breakers.

9. The electrical switching apparatus of claim 1 wherein the electrical switching assemblies are aircraft circuit breakers.

10. A method of interrupting at least a portion of a circuit with the electrical switching apparatus of claim 1, the method comprising:

triggering with the trip assembly of one of the electrical switching assemblies its operating mechanism to trip open its separable contacts, to deploy its indicator to its second position, and to translate its actuator device toward its OFF position; and employing the bridging device to move the actuator devices of the other electrical switching assemblies toward their OFF positions and to open their separable contacts.

11. The method of claim 10 wherein each of the electrical switching assemblies further comprises a biasing element, and further comprising biasing with the biasing elements the bridging device toward the OFF positions of the actuator devices.

12. The electrical switching apparatus of claim 1 wherein the trip assembly comprises an arc fault trip mechanism, and wherein the indicator of one of the electrical switching assemblies is structured to be deployed by its trip assembly when its arc fault trip mechanism detects an arc fault condition on a circuit that includes the one of the electrical switching assemblies.

13. An electrical switching apparatus comprising:

a plurality of electrical switching assemblies each comprising:

a housing, separable contacts, an operating mechanism structured to open and close the separable contacts, an elongated actuator device translatable along its direction of elongation between OFF and ON positions and cooperating with the operating mechanism to open and close the separable contact, and a trip assembly cooperating with the operating mechanism to trip open the separable contacts;

a connection assembly structured to mechanically connect together the electrical switching assemblies;

a bridging device structured to mechanically connect together the actuator devices;

wherein each electrical switching assembly further comprises a biasing element structured to bias the actuator device toward the OFF position; and wherein each electrical switching assembly further comprises a fastener structured to fasten the electrical switching assembly to a support, the fastener and the biasing element being coupled together.

14. An electrical switching apparatus comprising:

a plurality of electrical switching assemblies each comprising:

a housing, separable contacts, an operating mechanism structured to open and close the separable contacts, an elongated actuator device translatable along its direction of elongation between OFF and ON positions and cooperating with the operating mechanism to open and close the separable contact, and a trip assembly cooperating with the operating mechanism to trip open the separable contacts;

a connection assembly structured to mechanically connect together the electrical switching assemblies;

a bridging device structured to mechanically connect together the actuator devices; and wherein each electrical switching assembly further comprises an illumination element, and wherein the connection assembly comprises at least a first spacer formed of an at least partially translucent material and structured to be disposed adjacent one of the illumination elements.

15. An electrical switching apparatus comprising:

a plurality of electrical switching assemblies each comprising:

a housing, separable contacts, an operating mechanism structured to open and close the separable contacts, an elongated actuator device translatable along its direction of elongation between OFF and ON positions and cooperating with the operating mechanism to open and close the separable contact, and a trip assembly cooperating with the operating mechanism to trip open the separable contacts;

a connection assembly structured to mechanically connect together the electrical switching assemblies;

a bridging device structured to mechanically connect together the actuator devices; and wherein the trip assembly of each electrical switching assembly is structured trigger the operating mechanism to trip open the separable contacts at a nominal predetermined load, and wherein the nominal predetermined load of at least one of the electrical switching assemblies is different from the nominal predetermined load of another of the electrical switching assemblies.

16. A method of interrupting at least a portion of a circuit with an electrical switching apparatus that includes a plurality of electrical switching assemblies each including:

a housing, separable contacts, an operating mechanism structured to open and close the separable contacts, an elongated actuator device translatable along its direction of elongation between OFF and ON positions and cooperating with the operating mechanism to open and close the separable contact, and a trip assembly cooperating with the operating mechanism to trip open the separable contacts;

the electrical switching apparatus also including a connection assembly structured to mechanically connect together the electrical switching assemblies; and the electrical switching apparatus further including a bridging device structured to mechanically connect together the actuator devices;

the method comprising:

triggering with the trip assembly of one of the electrical switching assemblies its operating mechanism to trip open its separable contacts and to translate its actuator device toward its OFF position;

employing the bridging device to move the actuator devices of the other electrical switching assemblies toward their OFF positions and to open their separable contacts; and wherein the trip assembly of each electrical switching assembly is structured trigger its operating mechanism to trip open the separable contacts at a nominal predetermined load, and wherein the nominal predetermined load of one of the electrical switching assemblies connected with one circuit is different from the nominal predetermined load of another of the electrical switching assemblies connected with another circuit, and further comprising interrupting with the electrical switching apparatus the one circuit and the another circuit.

* * * * *